US005159865A

United States Patent [19]

Hinckley

[11] Patent Number: 5,159,865

[45] Date of Patent: Nov. 3, 1992

[54] VIBRATION DRIVEN HOT KNIFE FOR SEPARATING BONDED ASSEMBLIES

[75] Inventor: C. Douglas Hinckley, Federal Way, Wash.

[73] Assignee: The Boeing Company, Seattle, Wash.

[21] Appl. No.: 833,871

[22] Filed: Feb. 11, 1992

[51] Int. Cl.[5] ..... B26D 7/10

[52] U.S. Cl. ..... 83/16; 30/140; 30/277; 83/27; 83/102.1; 83/171

[58] Field of Search ..... 83/16, 27, 171, 102.1; 30/277, 140, 115, 277.4

[56] References Cited

U.S. PATENT DOCUMENTS

| | | | |
|---|---|---|---|
| 712,843 | 11/1902 | Paul | 173/30 |
| 2,174,646 | 10/1939 | Whitmer | 30/165 |
| 2,220,223 | 11/1940 | Eerhard et al. | 30/277 |
| 2,510,383 | 6/1950 | Dalgleish | 154/125 |
| 2,623,977 | 12/1952 | Weiskopf | 219/21 |
| 3,003,237 | 10/1961 | Chandler | 30/277 |
| 3,056,201 | 10/1962 | Chandler | 30/277 |
| 3,225,443 | 12/1965 | Young | 30/273 |
| 3,263,540 | 8/1966 | Lefevre | 83/171 |
| 3,378,429 | 4/1968 | Obeda | 156/515 |
| 3,469,479 | 9/1969 | Calemard | 83/16 |
| 3,789,712 | 2/1974 | Enders | 83/171 |
| 4,238,664 | 12/1980 | Anderson | 219/230 |
| 4,539,467 | 9/1985 | Wenger | 83/171 X |
| 5,050,469 | 9/1991 | Snelling | 83/171 X |

*Primary Examiner*—Frank T. Yost
*Assistant Examiner*—Kenneth E. Peterson
*Attorney, Agent, or Firm*—Conrad O. Gardner; B. A. Donahue

[57] ABSTRACT

A portable hand-cutting tool having a pair of perpendicularly arranged handles which is used for separating the trailing edge of bonded elevator or rudder skin panels following removal from an aircraft for repair. The tool features an electrically heated knife blade in combination with pneumatic controls for linearly vibrating the knife to achieve the cutting. The blade is fabricated from spring steel, has a leading edge sharpened with a full width taper, and is directly heated by way of electrical currents passing through the blade electrodes connected to the blade.

5 Claims, 1 Drawing Sheet

VIBRATION DRIVEN HOT KNIFE FOR SEPARATING BONDED ASSEMBLIES

BACKGROUND OF THE INVENTION

This invention relates to a portable tool, and more particularly, to a vibration driven hot knife.

Heretofore, prior art literature has been illustrative of heating or vibrating portable cutting tools. U.S. Pat. No. 3,469,479 to Calemard relates to a method and apparatus for dividing plastic materials and is comprised of an electric resistance-heated pin which is reciprocally pivoted by a cam action, in contrast to the present tool utilizing a linear pneumatic vibrator. U.S. Pat. Nos. 2,623,977 to Weiskopf and 4,238,664 to Anderson related to electric resistance-heated blade devices, however, do not include vibration.

In aircraft elevator and rudder assembly repair, removal of skin panels which are bonded together at the trailing edge is required. To effect this removal, the trailing edge must be separated. A major problem has been effecting quick separation of a trailing edge without damage to either of the costly skins.

THE PRESENT INVENTION

In accordance with the present invention, there is provided an electrically heated knife blade mounted as a cantilever in a tool body. The tool body is driven by a linear vibration source, and the tool is held and guided by an operator utilizing a pair of handles. The tool permits a single operator to separate a trailing edge without damage to either skin while providing access to the interior structure to make repairs.

DETAILED DESCRIPTION OF THE INVENTION

The invention will be described in more detail hereinafter with reference to the accompanying drawings, wherein like reference characters refer to the same parts throughout the several views and in which.

Figure 1:
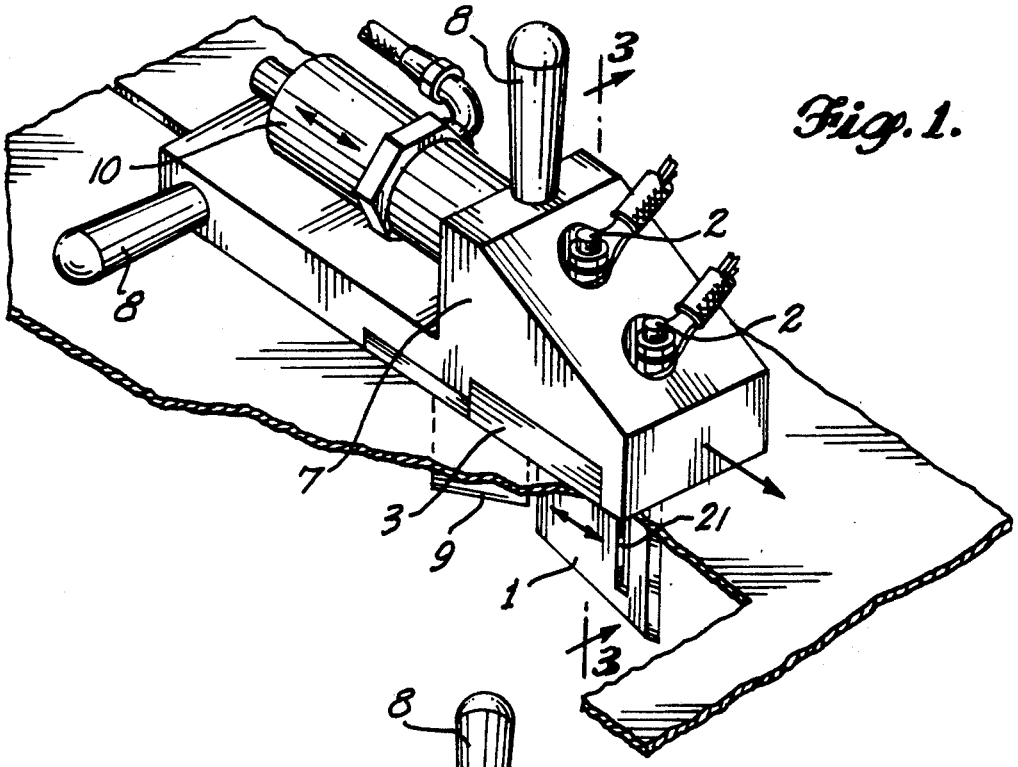
FIG. 1 is a top isometric view of a preferred embodiment of the vibration driven hot knife for separating bonded assemblies in accordance with the present invention.

Turning now to FIG. 1, there can be seen a thin blade 1 made of, e.g., 0.025 inch spring steel. Blade 1 is approximately 3 inches wide and of sufficient length to split the bonded assembly. Blade 1 has a slot 21 equal to between 75 and 90 percent of the length of blade 1. Slot 21 is parallel to and about 1 inch behind the leading knife edge of blade 1. Slot 21 defines a path for the electric current out through the leading knife edge of cantilevered blade 1 and back through the trailing edge of blade 1, thereby causing the relatively narrow leading cutting edge of blade 1 to be heated while leaving the rearward current return portion of blade 1 cool in relation thereto.

The leading cutting edge of blade 1 is sharpened to provide a cutting edge having a width of greater than about one-half inch, thereby providing a long tapered knife edge which permits the heated blade 1 to come into contact with the bonding material being cut even with very stiff skin panels. The wide trailing section of blade 1 provides stability, which prevents the sharpened leading edge from cutting into parts being separated.

Figure 3:
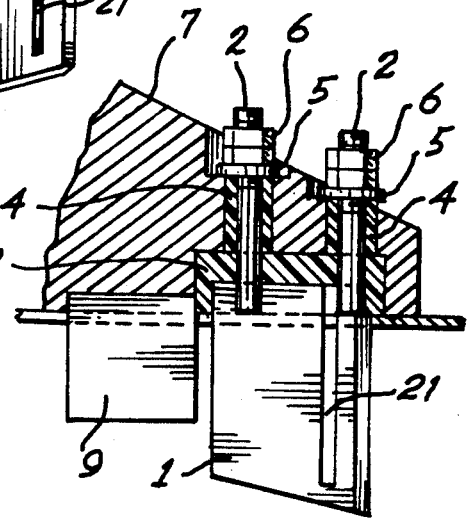
FIG. 3 is a vertical section taken along the lines 3—3 of FIG. 1 through the wedge and blade of the tool.

A pair of bolts 2 (seen in FIGS. 1 and 3) are attached to blade 1 to mount blade 1 in body 7 of the tool, and also for providing the electrical terminals for heating current flow to blade 1. Blade 1 is electrically insulated from body 7 of the tool since it is mounted in electrical insulator block 3 with bolts 2 passing through dielectric tubes 4 and dielectric washers 5. This blade assembly is held in tool body 7 by conventional nuts and locknuts 6. An electrical current source having a supply voltage of less than about 10 volts (AC or DC) is coupled between electrical terminals 2, thereby eliminating potential electrical hazards to the operator.

Figure 2:
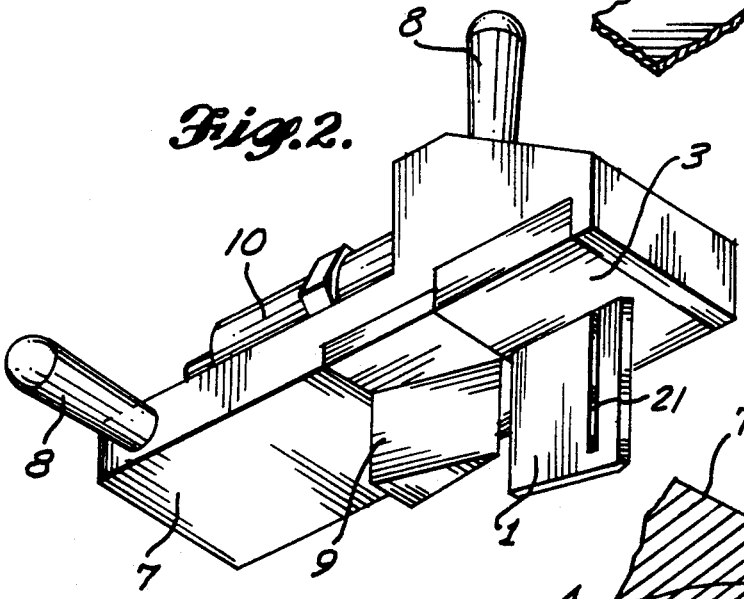
FIG. 2 is a bottom isometric view of the tool of FIG. 1.

Tool body 7 (seen in FIGS. 1–3) is made of aluminum or other lightweight material for the purpose of reducing tool weight, providing ease of handling by the operator, and to reduce mass, thereby maximizing vibration efficiency. Alternatively, tool body 7 can be made of a dielectric material (phenolic, fiberglass, nylon, etc.), thereby reducing the weight of the tool and the added complexity of blade installation by eliminating the need for insulator block and tubes. A pair of handles 8 are provided to enable the operator to support and control the splitting operation. The tool is of sufficient length so that handles 8 are far enough apart to allow the operator comfortable control of the tool.

Wedge member 9 (seen best in FIG. 2) made of a material having a low coefficient of friction, e.g. nylon or teflon, is disposed on the bottom surface of the tool with leading wedge edge positioned behind the trailing edge of blade 1, thereby spreading the parts being separated to reduce friction on the blade, thereby further improving the splitting efficiency.

Driver 10 for the tool is a vibration source (introducing motion in both directions, as shown by the arrows in FIG. 1, thereby also moving blade 1, as shown by the arrows thereon), such as a pneumatic linear vibrator or pneumatically vibrating rivet gun. The vibration/impact drives the tool forward through the workpiece. The size of the vibrator or rivet gun depends upon the specific application and task at hand. Vibrator 10 is attached to body 7, and if a rivet gun (standard or recoiless) is used, then the rivet gun may be attached to body 7 through use of an adapter which is press-fitted into or bolted to the tool body. In the event that a rivet gun is utilized as the vibration source, then the rear tool handle is unnecessary.

What is claimed is:

1. In combination in a portable tool:

an electrically heated knife blade having a leading knife edge and a trailing edge and having a predetermined length;

a pneumatically driven device for linearly vibrating said electrically heated knife blade;

said electrically heated knife blade sharpened with a full width taper; and, a wedge member having a leading edge disposed behind the trailing edge of said electrically heated knife blade and having a trailing edge thicker than said knife blade.

2. The portable tool according to claim 1, wherein said electrically heated knife blade includes a slot equal to between 75 and 90 percent of the length of said electrically heated knife blade.

3. The portable tool according to claim 2, wherein said slot is disposed Parallel to and about 1 inch behind the leading knife edge of said electrically heated knife blade.

4. A method for separating the trailing edge of bonded parts of skin panels prior to their removal from an aircraft structure for repair comprising the steps of:

heating a knife blade, said knife blade having a trailing edge;

utilizing a pneumatic source for linearly vibrating said heated knife blade; and, causing a wedge member to follow the trailing edge of the knife blade and thereby spreading the parts of said bonded parts of skin panels being separated to reduce friction on said knife blade.

5. In combination in a portable tool:

an electrically heated knife blade having a trailing edge;

a pneumatically vibrating rivet gun for linearly vibrating said electrically heated knife blade;

said electrically heated knife blade sharpened with a full width taper; and, a wedge member having a leading edge disposed behind the trailing edge of said electrically heated knife blade and having a trailing edge thicker than said knife blade.

* * * * *